US005960971A

United States Patent [19]

Bral

[11] Patent Number: 5,960,971

[45] Date of Patent: Oct. 5, 1999

[54] AUTOMATICALLY RINSING BABY BOTTLE

[76] Inventor: Hooshang Bral, 152 S. Beverly Dr., Beverly Hills, Calif. 90212

[21] Appl. No.: 08/836,542

[22] PCT Filed: Oct. 30, 1995

[86] PCT No.: PCT/US95/14592

§ 371 Date: Apr. 30, 1997

§ 102(e) Date: Apr. 30, 1997

[87] PCT Pub. No.: WO96/18371

PCT Pub. Date: Jun. 20, 1996

Related U.S. Application Data

[63] Continuation-in-part of application No. 08/356,723, Dec. 15, 1994, Pat. No. 5,617,966, which is a continuation-in-part of application No. 08/274,204, Jul. 12, 1994, abandoned.

[51] Int. Cl.[6] ..... A61J 9/00

[52] U.S. Cl. ..... 215/11.4; 215/DIG. 8; 215/6; 222/142.5

[58] Field of Search ..... 215/11.4, 111.1, 215/DIG. 8, 11.5, 6; 222/129, 145.1, 145.3

[56] References Cited

U.S. PATENT DOCUMENTS

| | | | |
|---|---|---|---|
| 2,655,279 | 10/1953 | Wolf . | |
| 2,680,441 | 6/1954 | Krammer . | |
| 2,786,769 | 3/1957 | Greenspan . | |
| 3,741,383 | 6/1973 | Wittwer . | |
| 4,410,085 | 10/1983 | Beneziat et al. . | |
| 4,548,339 | 10/1985 | Gorman . | |
| 4,821,895 | 4/1989 | Roskilly . | |
| 4,856,995 | 8/1989 | Wagner . | |
| 4,940,152 | 7/1990 | Lin | 215/11.5 |
| 5,029,701 | 7/1991 | Roth et al. . | |
| 5,244,122 | 9/1993 | Botts . | |
| 5,437,381 | 8/1995 | Herrmann . | |
| 5,617,966 | 4/1997 | Bral . | |

FOREIGN PATENT DOCUMENTS

| | | |
|---|---|---|
| 1 228 859 | 2/1962 | France . |
| 2 285 790 | 7/1995 | United Kingdom . |
| WO 95/24177 | 9/1995 | WIPO . |

*Primary Examiner*—Gary E. Elkins
*Assistant Examiner*—Tri M. Mai

[57] ABSTRACT

A nursing bottle for automatically rinsing a baby's teeth by independently dispensing first and second liquids, includes a nursing bottle having a nipple, a rinsing device having a dispensing end and a buoyant valve attached to the dispensing end for retaining the second liquid within the rinsing device while the nursing bottle receives the first liquid. The valve retains the second liquid within the rinsing device when the bottle is at least substantially inverted due to a buoyant force produced by the valve against the dispensing end. The buoyant force of the valve is greater than the force of gravity which acts on the valve until the first liquid is substantially dispensed from the bottle. After which, the force of gravity overcomes the buoyant force of the valve and the valve is pulled towards the nipple by the force of gravity. As a result, the valve automatically releases the second liquid from the rinsing device and into the nipple to rinse the baby's teeth.

23 Claims, 6 Drawing Sheets

AUTOMATICALLY RINSING BABY BOTTLE

This application is a Continuation-In-Part of application Ser. No. 08/356,723, filed Dec. 15, 1994, now, U.S. Pat. No. 5,617,966 which is a Continuation-In-Part of application Ser. No. 08/274,204, filed Jul. 12, 1994, now abandoned, the disclosure of which is hereby incorporated by reference.

FIELD OF THE INVENTION

This invention relates generally to a nursing bottle, and more particularly to a nursing bottle for babies which automatically rinses the baby's teeth after the contents of the nursing bottle have been emptied by dispensing a first liquid and subsequently dispensing a second liquid, independent of the first liquid, thus preventing decay of the baby's teeth.

BACKGROUND OF THE INVENTION

Typically, a baby goes to sleep after drinking a bottle of milk or formula from a nursing bottle. Likewise, a baby will fall completely asleep with a nursing bottle in its mouth while still drinking from the bottle. This results in the milk or other contents from the nursing bottle maintaining contact with the baby's teeth for extended periods of time which results in tooth decay of the baby's teeth.

A number of improvements have been made to the conventional nursing bottle for administering a second liquid which is distinct from the contents of the nursing bottle. However, these improvements have typically been in the area of medicine dispensing in connection with a nursing bottle. In these systems, a conventional baby bottle has a tube or syringe either within the bottle or on the exterior of the bottle. A first solution such as baby formula is placed within the bottle while medicine is placed within the tube. The two solutions are either mixed prior to administering both solutions to the baby or the second solution is manually released into the baby's bottle while the baby is ingesting the first solution. In both systems, the second solution is released manually and prior to the first solution being substantially emptied from the bottle.

For example, U.S. Pat. No. 2,680,441 to Krammer, issued Jun. 8, 1954, discloses a nursing bottle having a separate syringe attached to the nipple of the nursing bottle. The syringe contains a rubber bulb adjacent to the closed end of the bottle which must be manually depressed to empty the contents of the syringe.

More recently, U.S. Pat. No. 4,821,895 to Roskilly, issued Apr. 18, 1989, discloses a nursing bottle having a separate syringe attached to the nipple in a similar manner as the Krammer reference. The plunger of the syringe must be manually depressed to administer the contents of the syringe into the nipple of the nursing bottle.

Likewise, U.S. Pat. No. 5,244,122 to Botts, issued Sep. 14, 1993, also discloses a nursing bottle having a manually operated syringe disposed within the nursing bottle. However, as with the prior art, the plunger of the syringe must be manually operated which is inconvenient.

A related type of nursing bottle comprises two separate compartments within the nursing bottle, wherein one compartment is punctured to release the contents into the second compartment. For example, U.S. Pat. No. 2,786,769 to Greenspan, issued Mar. 26, 1957, discloses a nursing bottle having an inner compartment which is punctured using a threaded shank or screw, which must be manually operated from the exterior of the nursing bottle. However, the Greenspan reference does not rinse the baby's teeth as it is incapable of delivering a first liquid of the nursing bottle and subsequently delivering a second liquid to the baby. Instead, Greenspan discloses the manual mixing of both liquids prior to delivery of the solution to the baby.

Similarly, U.S. Pat. No. 3,741,383 to Wittwer, issued Jun. 26, 1973, discloses a nursing bottle having an inner compartment which is punctured with a sharp object such as a needle prior to administering the contents of the nursing bottle to the baby.

Another nursing bottle design is disclosed in U.S. Pat. No. 2,655,279 to Wolf, issued Oct. 13, 1953, wherein a flexible tube having a weighted end is placed within the nursing bottle. The tube has a hollow bore running throughout which allows passage of the contents of the nursing bottle to the nipple. The first end of the tube is attached to the nipple while the second end of the tube is placed near the bottom surface of the nursing bottle. The weighted member enables the tube to bend when the nursing bottle is moved from a vertical to a horizontal orientation. As a result, the second end of the tube remains submerged in the contents of the nursing bottle regardless of the orientation of the bottle thereby eliminating the excessive intake of air. However, this nursing bottle does not provide two separate compartments for independently delivering two separate liquids but instead provides a tube for delivering only one liquid.

Medicine dispensing nursing bottles are known and disclosed in, for example, U.S. Pat. No. 5,029,701 to Roth at al., issued Jul. 9, 1991, which has a medication vile disposed within the bottle. However, this nursing bottle does not allow any liquid to be dispensed from within the bottle itself but only from the medication vile which is completely sealed in relation to the nipple. Therefore, the bottle only houses the vile and is not in open communication with the it.

Accordingly, it would be desirable to provide a nursing bottle capable of delivering a first liquid to a baby, such as baby formula, and then rinsing the first liquid from the baby's mouth by subsequently delivering a second liquid, such as fluoride water, wherein the second liquid is delivered automatically upon the first liquid being substantially dispensed from the bottle.

SUMMARY OF THE INVENTION

Accordingly, it is an object of the present invention to provide an improved nursing bottle for rinsing a baby's teeth after drinking formula from the nursing bottle.

It is a further object of the present invention to provide a nursing bottle for rinsing a baby's teeth by automatically dispensing a second liquid subsequent to a first liquid.

In carrying out the above and other objects of the invention in one form, there is provided a nursing bottle, comprising a bottle, rinsing device, nipple and buoyant valve. The bottle has an open end for receiving the first liquid and a second closed end for retaining the first liquid. The rinsing device stores a second liquid and has a dispensing end adjacent the open end of the bottle for dispensing the second liquid within the bottle. The nipple is mounted on the open end of the bottle for dispensing the first and second liquids to the baby through the discharge hole of the nipple. The valve is positioned adjacent the dispensing end of the rinsing device for releasably retaining the second liquid within the rinsing device when the bottle is at least substantially inverted as the valve produces a buoyant force against the dispensing end of the rinsing device. The buoyant force produced by the valve is greater than the force of gravity which acts on the valve until the first liquid is substantially dispensed from the bottle. After which, the force of gravity overcomes the buoyant force of the valve and the valve is pulled towards the nipple by the force of gravity. As a result, the valve automatically releases the second liquid from the rinsing device and into the nipple to rinse the baby's teeth.

DETAILED DESCRIPTION OF THE INVENTION

Figure 1A:
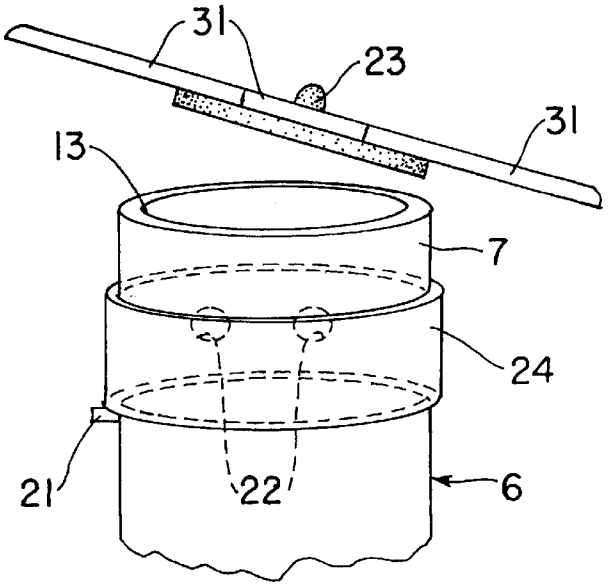
FIG. 1*a* is an enlarged view of the preferred buoyant valve of the present invention.

Referring to FIGS. 1–14, a nursing bottle 1 for babies includes a conventional bottle 2 having a screw-threaded neck 3, an annular screw-threaded bottle top 4, and a rubber teat or nipple 5 as is well known in the art. The nursing bottle 1 contains a rinsing device, preferably in the form of a hollow tube 6, positioned along a vertical axis 16 of the bottle 2. The tube 6 has first and second ends 7 and 8, respectively, wherein the first end has an opening 13 which is positioned in close proximity to the nipple S while the second end 8 is positioned in close proximity to an end wall 9 of the bottle 2. The second 8 may be attached, either permanently or releasably, to the end wall 9 but is preferably unattached. The bottle 2 receives a first liquid 2*a* such as milk or baby formula while the tube 6 receives a second liquid 6*a* such as water or a fluoride solution.

Figure 2:
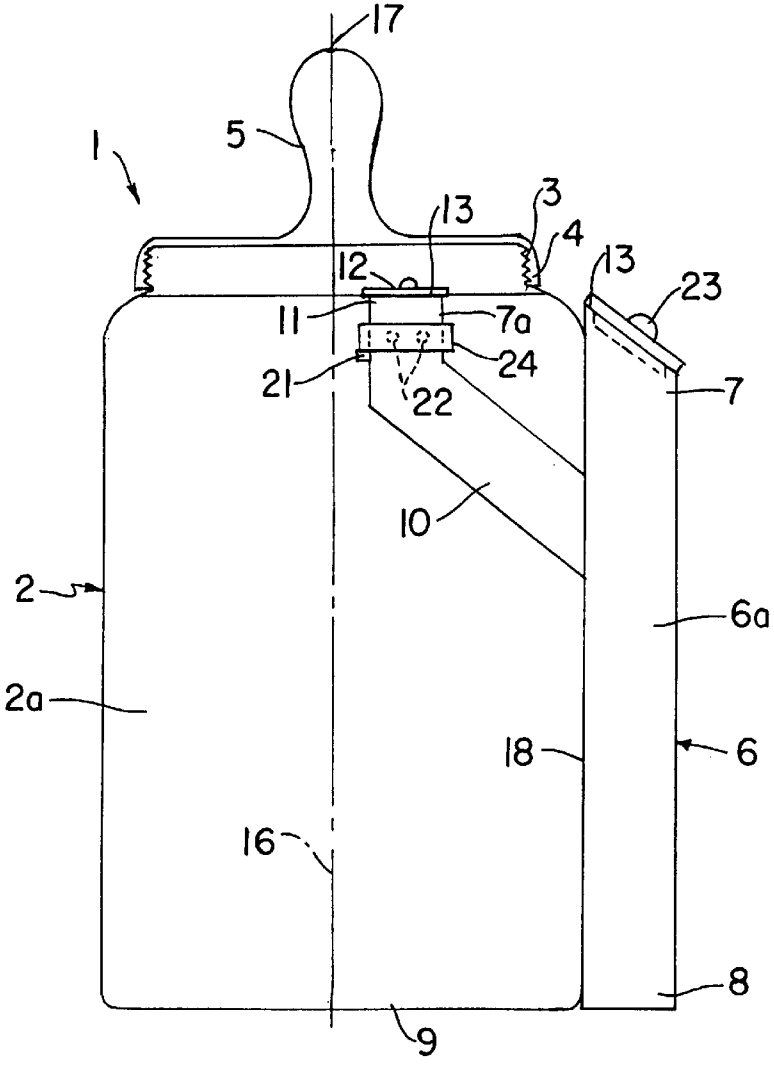
FIG. 2 is a side view of the preferred buoyant valve in an alternate embodiment of the present invention.

In the preferred embodiment, the tube 6 is positioned within the bottle 2; however, the tube 6 may be positioned on the exterior of the bottle 2. Furthermore, the tube 6 may be attached to a side wall 18 of the bottle 2 for delivery of the second liquid 6*a* to the bottle 2 through an armature 10 having an opening 11 as shown in FIG. 2. This enables the tube 6 to be filled without removing the nipple 5.

The first end 7 of the tube 6 preferably comprises a buoyant valve which retains the second liquid 6*a* within the tube 6 until the tube 6 is substantially inverted relative to the vertical axis 16. The buoyancy force exerted by the buoyant valve against the opening 13 of the tube 6, when the bottle 2 is substantially inverted, overcomes the force of gravity and retains the second liquid 6*a* within the tube 6 until the first liquid 2*a* is substantially dispensed from the bottle 2.

Preferably, the valve comprises a buoyant circular ring 24 (FIGS. 1–2) which encloses holes 22 in the tube 6 or an armature 10 to retain the second liquid 6*a* within the tube 6 until substantial delivery of the first liquid 2*a* from the bottle 2. However, the valve may comprise a variety of forms without deviating from the intent of the invention. For example, the valve may comprise a buoyant lid 14 attached by a hinge 15 directly to the tube 6 or to the armature 10 (FIGS. 3–6 and 10); a hook-like projection 20 which protrudes from the first end 7 of the tube 6 to substantially cover the opening 13 (FIGS. 7–9 and 11); a buoyant cap 28 having a sealed chamber 27 to increase buoyancy and also an aerating tube 26 attached substantially adjacent the second end 8 of the tube 6 (FIGS. 12 and 12*a*) and also attached substantially adjacent the first end 7 of the tube 6 (FIG. 13); or first and second aerating tubes 29 and 30 (FIG. 14) attached to the tube 6.

Figure 11:
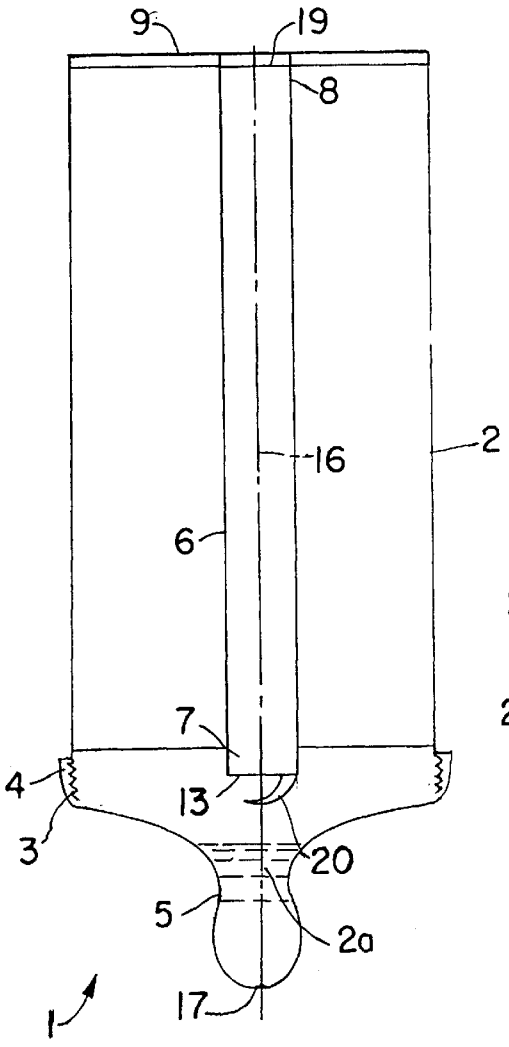
FIGS. 10 and 11 are side views of the alternate buoyant valve and alternate hook-like protrusion valve of the present invention in operation.
Figure 10:
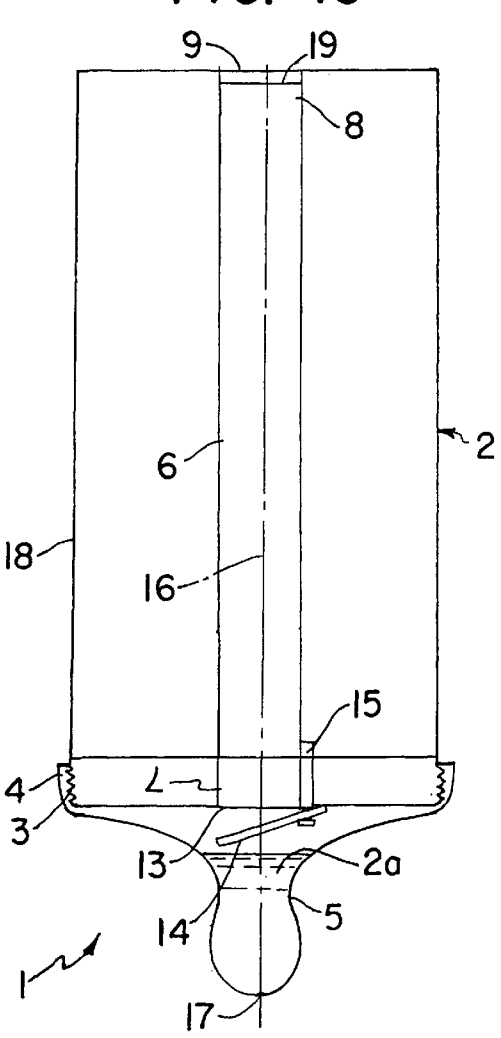

In all of the embodiments, with the exception of the hook-like protrusion 20 of FIGS. 7–9 and 11, the movement of the buoyant valve is a function of the orientation of the bottle 2. As the bottle 2 is moved from a vertical (i.e. upright) position as shown in FIGS. 1–9 and 12–14 to a substantially inverted position as shown in FIGS. 10 and 11, the force of gravity will act on the valve, depending on the level of inversion as the level of inversion will determine the amount of the valve which is submerged. As long as the first liquid 2*a* within the bottle 2 substantially covers the valve, the second liquid 6*a* will be retained within the tube 6 due to the buoyancy force of the valve acting against the dispensing end 7 of the tube 6. After the first liquid 2*a* is substantially dispensed from the bottle 2, the valve will not be submerged and there will be no buoyancy force to act against the tube 6. Instead, the valve will open due to the force of gravity pulling the valve downward toward the nipple 5. In the preferred embodiment, the circular ring 24 will be pulled downward toward the nipple 5, exposing the holes 22 and allowing the second liquid 6*a* to drain from the tube 6 into the bottle 2. This releasing of the second liquid 6*a* occurs automatically, after the first liquid 2*a* has been substantially dispensed, without the need to manually release the second liquid 6*a* as in the prior art.

Figure 1:
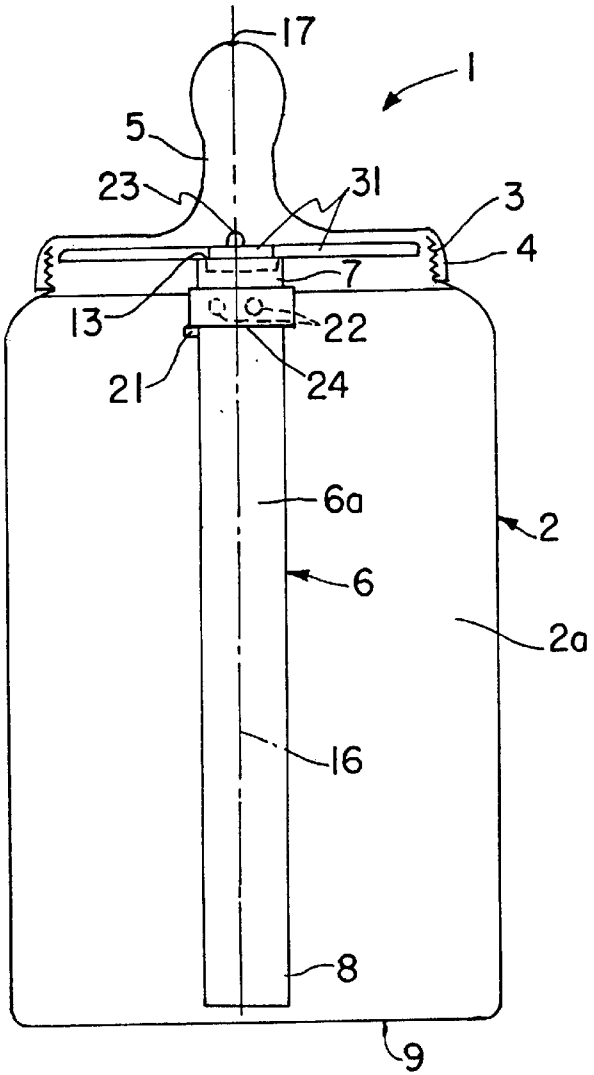
FIG. 1 is a side view of the preferred nursing bottle of the present invention.

Referring to FIGS. 1 and 2, the preferred valve comprises the circular ring 24 formed of a buoyant material, thus producing a buoyancy force when submerged within the first liquid 2*a*. The buoyant ring 24 enables the first and second liquids 2*a* and 6*a* to be ingested independently, that is, the second liquid 6*a* is ingested after substantial delivery of the first liquid 2*a* to the baby. The ring 24 is positioned substantially adjacent to the opening 13 (FIG. 1) having a removable cover 23 with extensions 31 which stabilize the tube 6 within the bottle 2 without the need to permanently or temporarily affix the tube 6 to the bottle 2. In the preferred embodiment, the cover 23 has four equally-spaced extensions 31 in the form of a cross-bar or "X" which project outward. This enables the tube 6 to be used as a separate insert which may be pre-packaged and disposable, similar to conventional disposable baby bottles.

In an alternate embodiment, the ring 24 is attached substantially adjacent to the opening 11 (FIG. 2) of an armature 10 which extends from the tube 6 and is covered by a cover 12. The ring 24 operates in the same manner as the ring 24 of FIG. 1; however, the tube 6 may be filled without removing the nipple 5. In FIG. 2, the opening 13 of the tube 6 is covered with the cover 23 while the opening 11 of the armature 10 is covered with the cover 12.

Preferably, the cover 12 is removably attached to the opening 13. The cover 12 may comprise a rubber stopper which engages the opening 13 using a press fit or may threadably engage the opening 13 without deviating from the intent of the invention. Furthermore, the tube 6 may be pre-filled for convenience, thus eliminating the need for any type of removable cover.

After the second liquid 6*a* is inserted within the tube 6, the opening 13 at the first end 7 of the tube 6 is sealed using the cover 23. The buoyant circular ring 24 is preferably positioned on the first end 7 of the tube 6 and is prevented from moving towards the second end 8 by a pin 21 when the bottle 2 is substantially inverted. When the circular ring 24 is held against the pin 21 due to the force of buoyancy of the ring 24, the ring 24 covers the holes 22 formed at the first end of the tube 6.

In operation, the bottle 2 is filled with a first liquid 2*a* and the tube 6 is filled with a second liquid 6*a*. When the bottle 2 is substantially inverted, the first liquid 2*a* will move from the end wall 9 towards the nipple 5. Since the circular ring 24 is formed of a buoyant material, the ring 24 exhibits a buoyancy force and floats upwards, towards the end wall 9. The ring 24 will thus engage the pin 21 and cover the holes 22 as shown in FIG. 1. As the first liquid 2*a* is substantially dispensed from the bottle 2, the first liquid 2*a* no longer submerges the circular ring 24 and the buoyancy force is diminished depending on the level of submersion. As a result, the force of gravity overcomes the force of buoyancy of the ring 24 and the force of gravity pulls the ring 24 towards the nipple 5. Consequently, the holes 22 are exposed and the second liquid 6*a* automatically drains from the tube 6, into the bottle 2 and towards the nipple 5 where it is dispensed to the baby through a discharge hole 17. The baby will then continue to feed on the bottle 2, thus delivering water or a fluoride solution to the baby through the discharge opening 17 in the nipple 5. The water will then rinse the formula from the baby's mouth, thus preventing tooth decay. Unlike the prior art, the present invention automatically delivers the rinsing solution to the baby.

Dispensing the second liquid 6*a* in this manner avoids significant disadvantages over the prior art. For example, the second liquid 6*a* is dispensed automatically, activated by the force of gravity, and not manually. In this way, there is no need to monitor the bottle 2 during nursing to determine when the second liquid 6*a* should be released. In addition, the first and second liquids 2*a* and 6*a* are delivered independently of one another, eliminating any need to change liquids after delivery of the first liquid 2*a* to the baby.

Figure 3:
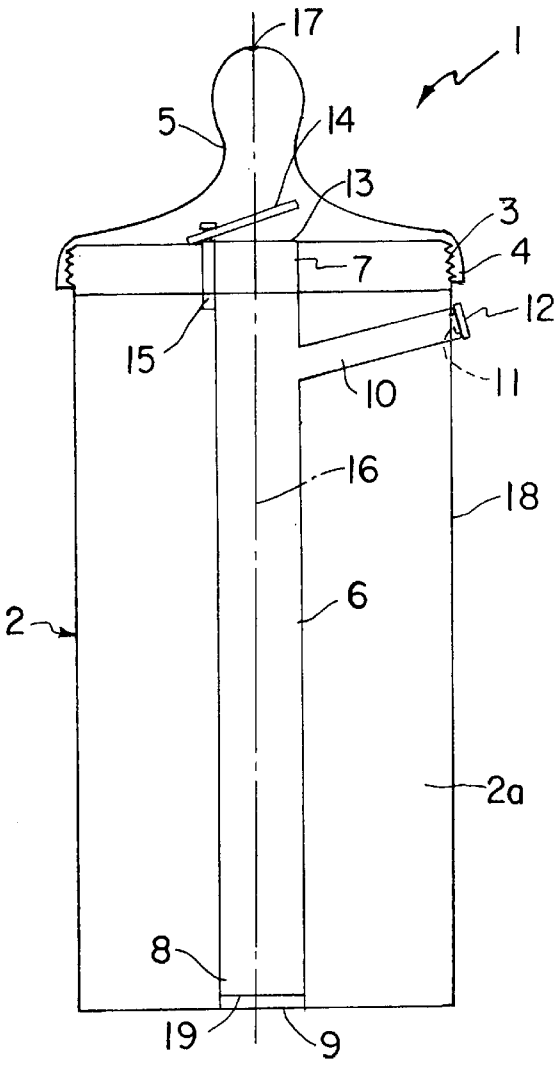
FIGS. 3–6 are side views of alternate buoyant valves of the present invention.
Figure 6:
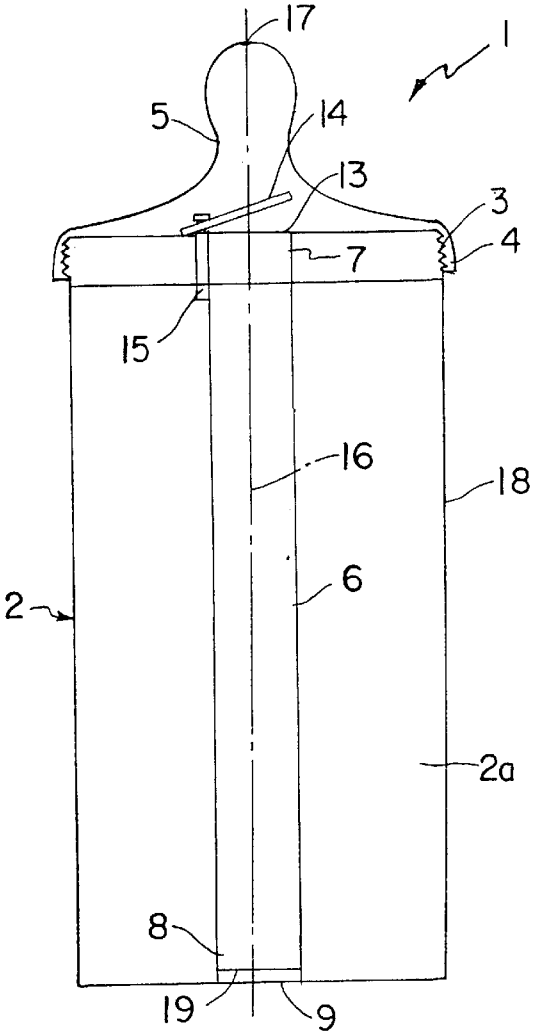
Figure 5:
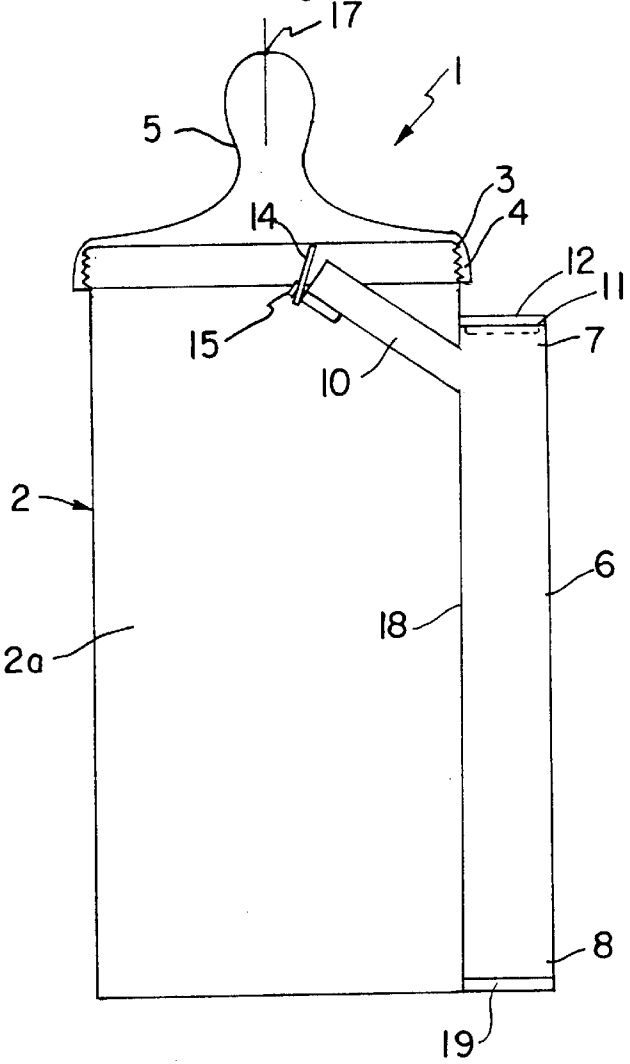
Figure 4:
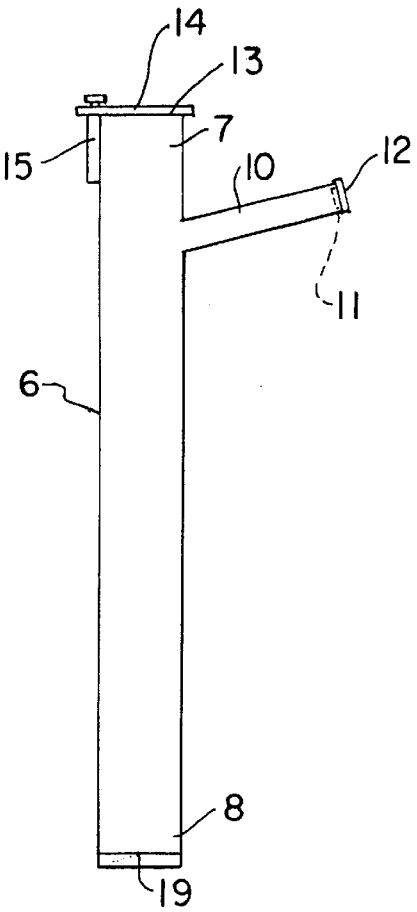
Figure 9:
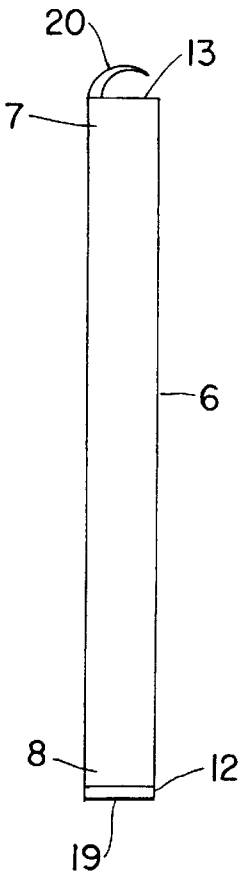
FIGS. 7–9 are side views of the alternate hook-like protrusion valve of the present invention.
Figure 8:
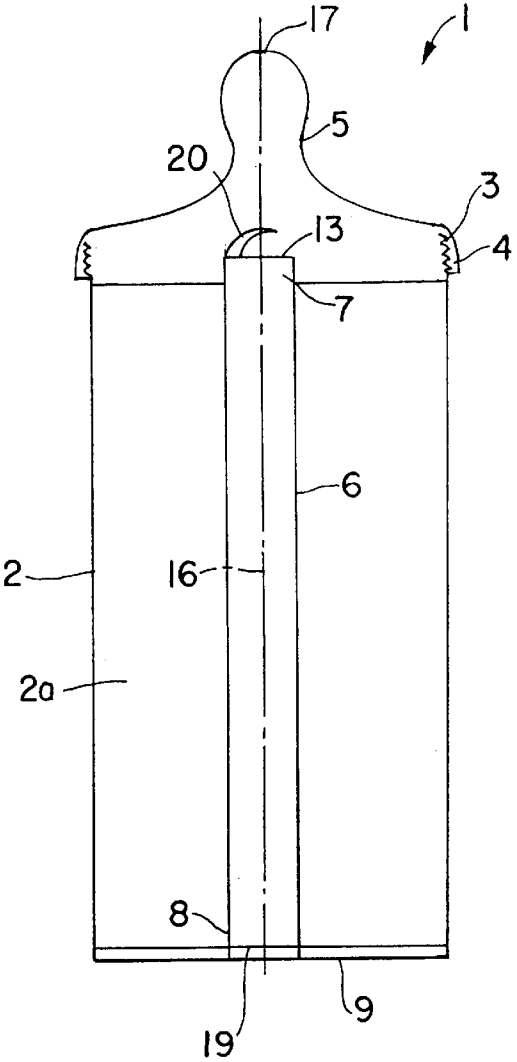

Referring to FIGS. 3–6, the alternate valve of the bottle 2 comprises a buoyant lid 14 attached by a hinge 15 to either the opening 13 of the tube 6 or the opening 11 of the armature 10. In FIGS. 3 and 4, the second liquid 6*a* is inserted directly into the armature 10 for supply of the second liquid 6*a* to the tube 6. The cover 12 covers the opening 11 to seal the armature 10 after insertion of the second liquid 6*a*. In FIG. 5, the second liquid 6*a* is inserted directly into the opening 13 of the tube 6, which is placed on the exterior of the bottle 2 for supply to the armature 10. In FIG. 6, the second liquid 6*a* is inserted directly into the opening 13 of the tube 6, which is also used to dispense the second liquid 6*a*, without the use of the armature 10.

The tube 6 may be filled with the second liquid 6*a* through an opening 19 at the second end 8 of the tube 6 as shown in FIGS. 3–6 and 9–11. The opening 19 is sealed in the same manner as the openings 11, 13 which are sealed with the cover 12.

In operation, the bottle 2 is filled with the first liquid 2*a* such as baby formula or other liquid and the tube 6 is filled with a second rinsing liquid 6*a* such as water. When a vertical axis 16 as shown in FIG. 3 is moved such that the nipple 5 is in a substantially inverted or downwardly directed orientation (FIG. 10), the buoyancy force of the buoyant lid 14 acts against the opening 13 of the tube 6 or the opening 11 of the armature 10, thus preventing the second liquid 6*a* from dispensing. When the first liquid 2*a* of the bottle 2 has substantially emptied from the bottle 2, the force of gravity acting on the lid 14 and second liquid 6*a* will overcome the buoyancy force and will force the lid 14 to an open position as shown in FIG. 10. Until the contents of the bottle 2 are substantially emptied, the buoyant lid 14 will remain in a closed position as shown in FIG. 4 and retain the second liquid 6*a* independently of the first liquid 2*a*.

Figure 7:
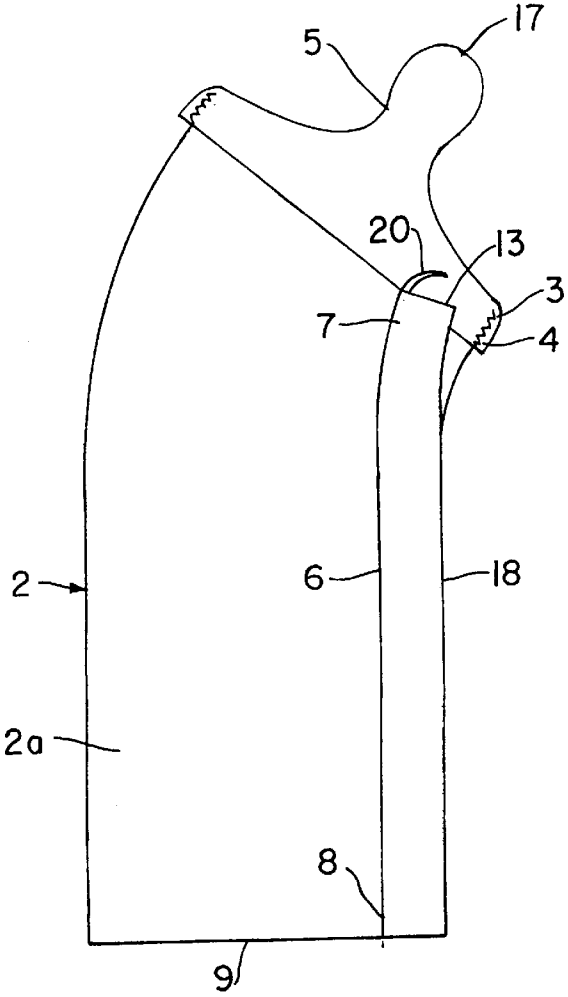

Referring to FIGS. 7–9 and 11, the alternate valve comprises the hook-like projection 20 which is preferably curved and projects substantially over the opening 13 to retain the second liquid 6*a* within the tube 6. The second liquid 6*a* will remain within the tube 6 as long as a sufficient amount of the first liquid 2*a* remains in the bottle 2 to substantially submerge the opening 13 as the first liquid 2*a* acts against the second liquid 6*a* at the opening 13. However, once the first liquid 2*a* is substantially dispensed from the bottle 2 such that the first liquid 2*a* is below the level of the opening 13 as shown in FIG. 11, the force of gravity will act on the second liquid 6*a* and pull the second liquid 6*a* towards the nipple 5. The bottle 2 may be configured to facilitate drainage of the second liquid as shown in FIG. 7 without deviating from the intent of the invention.

Referring to FIGS. 10 and 11, in operation, the lid 14 and the hook-like protrusion 20 releasably retain the second liquid 6*a* within the tube 6 until the first liquid 2*a* is substantially dispensed from the bottle 2, after which the force of gravity acts on the second liquid 6*a* when the bottle is at least substantially inverted to release the second liquid 6*a* within the bottle 2. The force of gravity acts on the valve after the first liquid 2*a* is substantially dispensed. In FIG. 10, the buoyant force of the lid 14 in the direction of the end wall 9 is no longer sufficient to overcome the force of gravity acting on the lid 14 and the second liquid 6*a* in the direction of the nipple 5 and the second liquid 6*a* contained within the tube 6 is automatically released into the bottle 2. In FIG. 11, the force of gravity acts only on the second liquid 6*a* as the hook-like protrusion 20 is stationary. Once the first liquid 2*a* is substantially dispensed from the bottle 2, the hook-like projection is not sufficient to retain the second liquid 6*a* since the projection 20 only substantially covers the opening 13.

Figure 12:
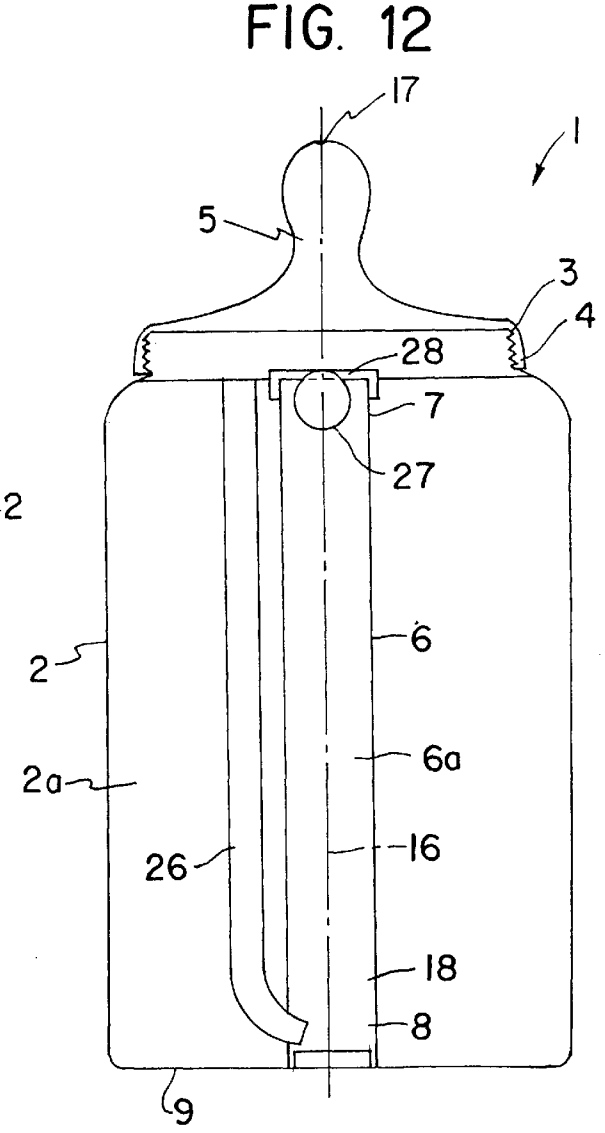
FIG. 12 is a side view of an alternate buoyant valve with an aerating tube attached to the second end of the tube.
Figure 13:
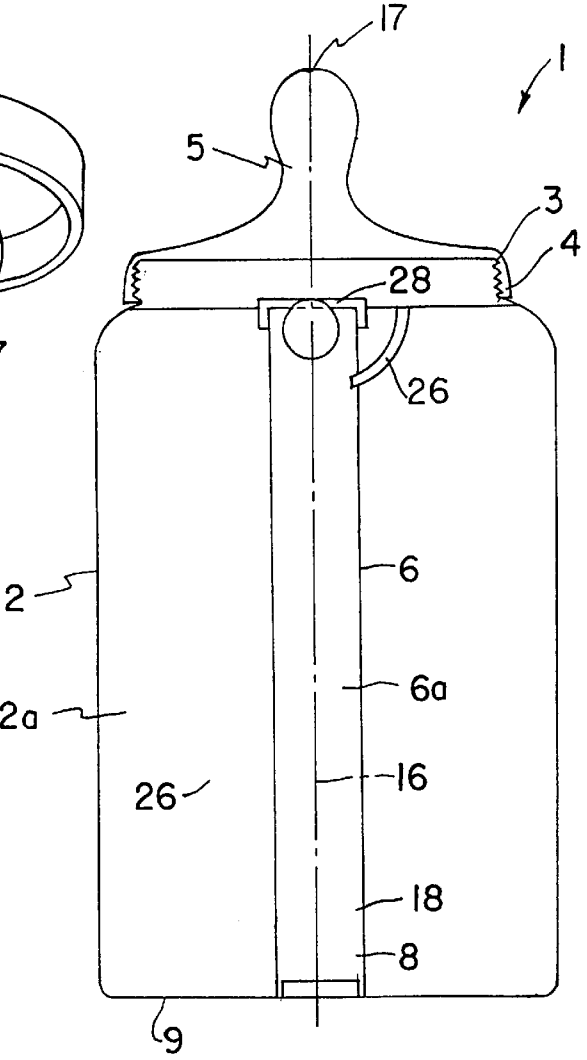
FIG. 13 is a side view of the alternate buoyant valve of FIG. 12 with the aerating tube attached adjacent the first end of the tube.
Figure 12A:
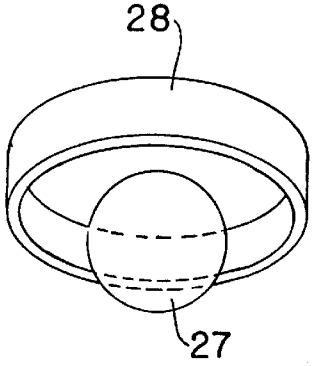
FIG. 12*a* is an isolated view of the buoyant cap and sealed chamber of FIG. 12.

Referring to FIGS. 12, 12*a* and 13, the alternate valve comprises the cap 28 having the sealed chamber 27 which provides additional buoyancy and the aerating tube 26 which may be attached at the first end 7 (FIG. 13) or the second end 8 (FIG. 14) of the tube 6. The sealed chamber 27 may comprise a variety of configurations without deviating from the intent of the invention. For example, in FIG. 12*a*, the sealed chamber 27 comprises a hollow ball which is attached to the cap 28. In addition, the length and positioning of the aerating tube 26 may be modified without deviating from the invention.

The buoyant cap 28 retains the second liquid 6*a* within the tube 6 until the first liquid 2*a* is substantially dispensed after which the force of gravity acts on the cap 28 and the second liquid 6*a* to push the cap 28 from the opening 13 and towards the nipple 5. As a result, the second liquid 6*a* is released into the bottle 2.

In an alternate embodiment, the cap 28 could be utilized alone provided the cap 28 is formed of a material which is sufficiently buoyant to overcome the force of gravity when the bottle 2 is substantially inverted. The buoyancy force of the cap 28 overcomes the force of gravity as long as the first liquid 2*a* substantially covers the cap 28. When the first liquid 2*a* has substantially drained from the bottle 2, the buoyancy force is diminished and the force of gravity pulls the cap 28 towards the nipple 5, releasing the second liquid 6*a*.

Figure 14:
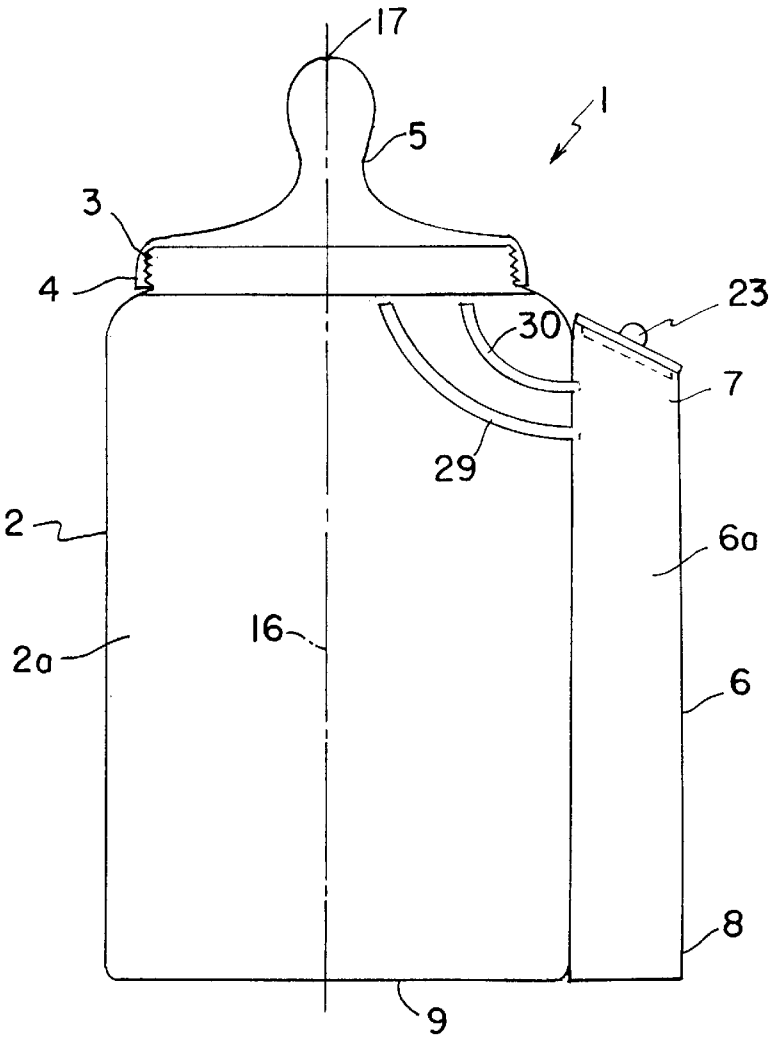
FIG. 14 is a side view of an alternate embodiment with the rinsing device externally attached to the bottle and two aerating tubes extending from the rinsing device.

Referring to FIG. 14, the valve comprises first and second tubes 29 and 30 which are attached to the tube 6 and which release the second liquid 6*a* from the tube 6 to the bottle 2 when the first liquid 2*a* is substantially dispensed from the bottle 2. The length and positioning of the tubes 29 and 30 may be modified without deviating from the intent of the invention. Specifically, the tube 29 may be positioned adjacent the second end of the tube 6. In operation, after the first liquid 2*a* was substantially dispensed from the bottle 2 such that the free ends of the tubes 29 and 30 were no longer submerged, the tube 29 intakes air. This intake of air releases the suction within the tube 6, and the second liquid 6*a* is released through the tube 30 due to the force of gravity acting on the second liquid 6*a* when the bottle 2 is substantially inverted.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed.

For example, it should be noted that the first and second liquids 2*a* and 6*a* could be dispensed as a mixture by changing the placement of the holes 22 or the placement of the aerating tubes 26, 29 and 30. For example, dispensing medicine to a baby has typically been accomplished manually. Using the present invention, the holes 22 could be positioned midway between the first and second ends 7 and 8 on the tube 6. Upon filling the bottle 2 to capacity, the second liquid 6*a* within the tube 6 is released after approximately one half of the first liquid 2*a* is dispensed. At this point, one half of the second liquid 6*a* is released into the bottle 2. Similarly, several valves could be placed on the tube 6 which results in a staggered release of the second liquid 6*a* within the tube 6. In addition, by modifying the positioning and/or length of the aerating tubes 26, 29 and 30, the second liquid 6*a* could be released to mix with the first liquid 2*a* prior to the substantial delivery of the first liquid 2*a*. Therefore, the invention is limited only by the appended claims.

What is claimed is:

1. A nursing bottle for automatically rinsing a baby's teeth, comprising:

a bottle for storing a first liquid having an open end for receiving said first liquid and a second closed end;

a rinsing device defining a container for storing a second liquid, the rinsing device having a dispensing end positioned in said bottle to dispense said second liquid through said open end of said bottle;

a nipple mounted on said open end of said bottle to receive said first and second liquids from said open end and to dispense said first and second liquids through a discharge hole of said nipple; and a valve positioned at said dispensing end of said rinsing device, the valve comprising:

an outer surface on said dispensing end defining at least one dispensing hole in fluid communication with said container;

a stop member; and a buoyant member movable from a first position covering said at least one dispensing hole, to a second position wherein said at least one dispensing hole is at least partially uncovered, the valve for releasably retaining said second liquid within said container when said bottle is at least substantially inverted, whereby, when said bottle is at least substantially inverted, said buoyant member is submerged in said first liquid such that a buoyant force directed towards said closed end of said bottle holds the buoyant member in said first position against said stop member until said first liquid is substantially dispensed from said bottle, whereupon said buoyant member is released from the buoyant force and falls toward said second position, thereby at least partially uncovering said at least one dispenser hole to release said second liquid from said rinsing device into said nipple from which said second liquid can be dispensed through the discharge hole to rinse the baby's teeth.

2. The nursing bottle of claim 1, wherein said first and second liquids are dispensed sequentially and independently of one another.

3. The nursing bottle of claim 1, wherein said buoyant member comprises a buoyant cap and the stop member comprises a portion of the buoyant cap.

4. The nursing bottle of claim 3, wherein said buoyant cap has a sealed chamber for increasing the buoyancy force.

5. The nursing bottle of claim 3, wherein said outer surface is an annular end wall of said dispensing end, and said annular end wall defines the dispensing hole, and wherein the cap comprises a cap end wall and a sleeve extending from the cap end wall, the sleeve is dimensioned to receive the annular end wall of the dispensing end such that the cap end wall covers the dispensing hole, and the cap end wall is the stop member at least one hole in said rinsing device which is covered by a circular ring when said circular ring is substantially submerged within said first liquid, said circular ring being held in position against a pin attached to said rinsing device.

6. The nursing bottle of claim 1, wherein said buoyant member comprises a buoyant lid mounted to said dispensing end of said rinsing device and the stop member comprises a surface of the buoyant lid.

7. The nursing bottle of claim 6, wherein said buoyant lid is removably attached to said rinsing device.

8. The nursing bottle of claim 1, wherein said rinsing device is removably attached to said bottle.

9. The nursing bottle of claim 1, wherein said rinsing device further comprises a receiving end opposite of said dispensing end for receiving said second liquid.

10. The nursing bottle of claim 1, wherein said rinsing device is positioned within said bottle.

11. The nursing bottle of claim 10, wherein said second liquid is received within said rinsing device through an extension of said rinsing device which communicates between the exterior of said bottle and said rinsing device.

12. The nursing bottle of claim 1, wherein said rinsing device is positioned externally of said bottle.

13. The nursing bottle of claim 12, wherein said second liquid is received within said bottle through an extension of said rinsing device which communicates between said rinsing device and the interior of said bottle.

14. The nursing bottle of claim 1, wherein said dispensing end of said rinsing device is capable of receiving said second liquid.

15. The nursing bottle of claim 1, further comprising at least one aerating tube having first and second ends attached to said rinsing device which communicates between said bottle and said rinsing device.

16. The nursing bottle of claim 15, wherein said first end of said at least one aerating tube communicates with said bottle, substantially adjacent said nipple, and said second end of said at least one aerating tube communicates with said rinsing device, substantially adjacent said closed end of said bottle.

17. The nursing bottle of claim 1, wherein at least one of said bottle, said rinsing device, said nipple and said valve are disposable.

18. The nursing bottle of claim 1 wherein the outer surface is a cylindrical outer surface, the buoyant member is a buoyant ring with an aperture dimensioned to closely receive the cylindrical outer surface such that the buoyant ring is movable from the first position to the second position on the dispensing end.

19. The nursing bottle of claim 18 wherein the stop member is attached to the buoyant ring and extends from the buoyant ring into the aperture to contact a lower end wall of the dispensing end.

20. The nursing bottle of claim 18 wherein the stop member is attached to the dispensing end and extends out from the cylindrical outer surface to contact an upper end wall of the buoyant ring.

21. A nursing bottle for automatically rinsing a baby's teeth, comprising:

a bottle for storing a first liquid having an open end for receiving said first liquid and a second closed end;

a rinsing tube for storing a second liquid having a dispensing end within said bottle for dispensing said second liquid within said bottle;

at least one aerating tube having first and second ends for communicating between said rinsing tube and said bottle, said first end attached to said tube;

a nipple mounted on said open end of said bottle for dispensing said first and second liquids through a discharge hole of said nipple and a valve positioned at said dispensing end of said rinsing tube, the valve comprising:

an outer surface on said dispensing end defining at least one dispensing hole in fluid communication with said container;

a stop member, and a buoyant member movable from a first position covering said at least one dispensing hole, to a second position wherein said at least one dispensing hole is at least partially uncovered, the valve for releasably retaining said second liquid within said rinsing tube when said bottle is at least substantially inverted, whereby said buoyant member is submerged in said first liquid producing a buoyant force on said buoyant member directed towards said closed end of said bottle until said first liquid is substantially dispensed from said bottle, after which said buoyant member falls toward said second position, thereby automatically releasing said second liquid into said nipple to thereby rinse the baby's teeth.

22. The nursing bottle of claim 21, wherein said first end of said at least one aerating tube is connected adjacent said second end of said rinsing tube.

23. A rinsing device for automatically rinsing a baby's teeth, the device being attached to a nursing bottle, the nursing bottle defining a contained storage area for a first liquid, the nursing bottle having a first open end for receiving said first liquid and for mounting a nipple having a discharge hole in fluid communication with the storage area, the nursing bottle having a second closed end, the rinsing device comprising:

a container for storing a second liquid;

a dispensing end positioned in said bottle to dispense said second liquid to said discharge hole; and a valve at said dispensing end of said rinsing device, the valve comprising:

an outer surface of said dispensing end defining at least one dispensing hole in fluid communication with said container;

a stop member; and a buoyant member movable from a first position covering said at least one dispensing hole, to a second position wherein said at least one dispensing hole is at least partially uncovered, whereby, when said bottle is at least substantially inverted, said buoyant member is submerged in said first liquid such that a buoyant force directed towards said closed end of said bottle holds the buoyant member in said first position against said stop member until said first liquid is substantially dispensed from said bottle, whereupon said buoyant member is released from the buoyant force and falls toward said second position, thereby uncovering said at least one dispenser hole, releasing said second liquid from said rinsing device into said bottle from which said second liquid can be dispensed through the discharge hole to rinse the baby's teeth.

* * * * *